US008324494B1

(12) United States Patent
Packouz

(10) Patent No.: US 8,324,494 B1
(45) Date of Patent: Dec. 4, 2012

(54) SYNTHESIZED PERCUSSION PEDAL

(76) Inventor: David Packouz, Miami, FL (US)

( * ) Notice: Subject to any disclaimer, the term of this patent is extended or adjusted under 35 U.S.C. 154(b) by 0 days.

(21) Appl. No.: 13/330,645

(22) Filed: Dec. 19, 2011

(51) Int. Cl.

| | |
|---|---|
| ***G10H 1/40*** | (2006.01) |
| ***G10H 7/00*** | (2006.01) |
| ***G10H 1/32*** | (2006.01) |
| ***G10H 1/00*** | (2006.01) |

(52) U.S. Cl. ..... 84/635; 84/746

(58) Field of Classification Search ..... 84/635, 84/611, 667, 645, 713, 721, 746
See application file for complete search history.

(56) References Cited

U.S. PATENT DOCUMENTS

| | | | | |
|---|---|---|---|---|
| 3,649,736 | A * | 3/1972 | Van Der Kooij | 84/713 |
| 5,192,823 | A * | 3/1993 | Suzuki et al. | 84/600 |
| 5,223,655 | A * | 6/1993 | Watanabe et al. | 84/637 |
| 5,786,540 | A * | 7/1998 | Westlund | 84/645 |
| 5,915,288 | A * | 6/1999 | Gabriel | 84/609 |
| 5,986,200 | A * | 11/1999 | Curtin | 84/609 |
| 8,106,283 | B2 * | 1/2012 | Nishitani et al. | 84/612 |
| 2001/0015123 | A1 * | 8/2001 | Nishitani et al. | 84/615 |

* cited by examiner

*Primary Examiner* — Jeffrey Donels

(74) *Attorney, Agent, or Firm* — Christopher J. Vandam PA; Chris Vandam

(57) ABSTRACT

A MIDI signal generator adapted for foot pedal operated percussion synthesis having, inter alia, independent volume, reverb, loop, fill, tempo and style controls. An important feature is the ability to cycle through a series of pre-selected rhythm loops. Each rhythm loop further has a subset of associated fills that are initiated with specific touches to the foot pedal. The device is computer integrated to match any of the stored rhythm loops with any subset of fills.

6 Claims, 5 Drawing Sheets

TIME →

| 85 | 86 | 87 | 88 | 89 | 90 | 90a | 90b | 90c | 90d | 91 | 91a | 91b | 92 | 93 | 94 | 95 |
|---|---|---|---|---|---|---|---|---|---|---|---|---|---|---|---|---|
| A | $F^A_1$ | A | $F^A_2$ | A | $F^A_3$ | A | $F^A_1$ | A | $F^A_T$ | B | $F^B_1$ | B | $F^B_2$ | B | $F^B_T$ | A |
| tap | tap | | tap | | tap | | tap | | hold | release | tap | | tap | | hold | release 2 tap |

A= Rhythm loop first type

B= Rhythm loop second type $F^X_y$= Fill sequence

X= Identifies which rhythm loop into which the fill is integrated

Y= Fill type [#= Variation; T= Transition fill]

Figure 4

SYNTHESIZED PERCUSSION PEDAL

BACKGROUND OF THE INVENTION

1. Field of the Invention

The present invention relates to music production, and more particularly, to foot operated synthesized percussion accompaniment pedals.

2. Description of the Related Art

Several designs for percussion pedals have been designed in the past. None of them, however, includes a computer programmable foot operated percussion pedal that is fully customizable to interject multiple and distinct sequential fills each in a plurality of cyclic percussion rhythm sequences at the musician's command.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a hands free percussion pedal that can transition between a series of pre-selected primary rhythms where each primary rhythm has a subset of predetermined specifically sequenced fills.

Another object of the present invention is to provide in a single box the ability to control a large number and variety of a complex series of percussion rhythms.

It is another object of this invention to provide a synthesized percussion generator controlled by one's foot that integrates into a standard foot pedal daisy chain.

It is still another object of the present invention, to provide a synthesized percussion pedal that has programmable memory to modify the available beats, styles, MIDI waveforms and other features of the digitally produced sound.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 4 is a chart demonstrating an example of how various rhythms may be played as a function of time.

DETAILED DESCRIPTION OF THE PREFERRED EMBODIMENT

Figure 1:
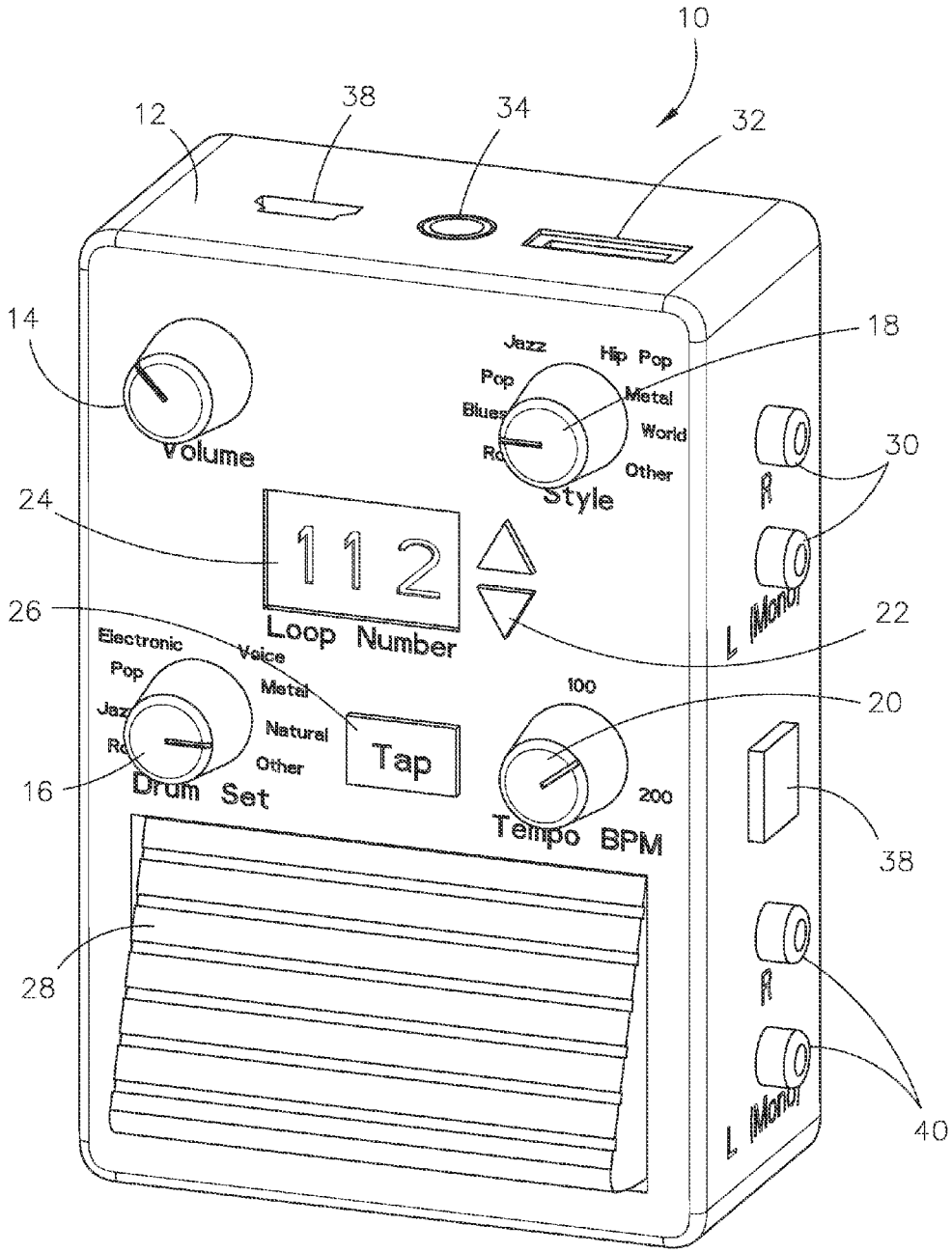
FIG. 1 represents a perspective view of a variation of the device.

Musicians have used foot operated pedals to add effects and other inputs for some time. Typically, one or multiple foot pedals are used to allow the musician the ability to have his hands free to play a primary instrument, such as a guitar, while retaining the ability to add complexity to the music with his foot.

More complex users may have a 'daisy chain' of pedals that, for example, add properties altering the resulting sound with effects like reverb or distortion. Daisy chained pedals can be rack mounted to hold the pedals in place and provide a power supply and the signal wiring means often taking the form of a wiring harness. In most cases the pedals are placed on the floor in front of the performer.

Referring now to the drawings, where the present invention is generally referred to with numeral 10, it can be observed that it basically includes a case 12, a selector 14, a selector 16, a selector 18, a selector 20, a selector 22, a display 24, a sensor 26, a pedal 28, inputs 30, a card slot 32, a port 34, a port 36, a port 38 and outputs 40.

Generally, the present invention is a MIDI (musical instrument digital interface) sound generator housed in a case 12 constructed of a rigid and durable material such as metal or a high impact polymer to survive significant abuse, wear and tear.

A plurality of controls are located on the upper face of the case 12 so that they are viewable when standing above the pedal. A preferred configuration of the controls in shown in FIG. 1 to be comprised of a volume selector 14, a drum set selector 16, a style selector 18, a tempo selector 20 and a loop number selector 22.

An internal memory storage means, such as solid state memory, flash memory, hard-drive or other memory device is fixed inside the case 12. The memory storage means holds a pre-selected set of MIDI rhythms. Each MIDI rhythm is designated a loop number. Loop numbers correspond to the style selector. In a preferred variation of the device for each style (i.e. rock, jazz, etc. . . . ) there are up to nine hundred ninety-nine loop sequences (or 'songs'). As shown in FIG. 1 the loop number one hundred twelve is selected which designates a specific MIDI file comprising a segment of instructions that correspond to, in this example, a percussion sequence. The current loop number selected is easily identified on the numerical display 24 for easy reference and navigation through the various available loops.

Figure 5:
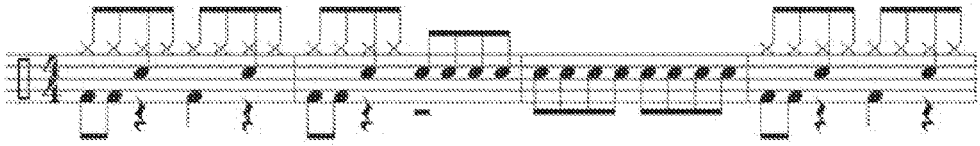
FIG. 5 is a sheet music representation of an example of a MIDI percussion loop.

In the device's most simple use, as can be done by other MIDI generator devices, the MIDI sequence is repetitively looped. In other words, the full MIDI file is played, and when completed, it immediately starts over from the beginning to repeat the cycle. An example of a MIDI percussion loop is shown in FIG. 5, represented in traditional sheet music format.

In a preferred configuration, the MIDI sequence is initiated by a brief tap with the foot onto the pedal 28. The device then executes the MIDI file and sends an analog audio signal out through the outputs 40. Typically the signal is then transmitted to an external amplifier where it is broadcast to the audience. In some applications the outputs 40 are fed into another external device that may manipulate or otherwise interact with the signal as produced by the device.

The internal storage means may store dozens or hundreds of unique MIDI files, each representing a distinct percussion sequence. The loop number selector 22 may be utilized to move between the various MIDI files. An example of a loop is represented in FIG. 5 in a traditional percussion sheet music notation format.

The drum set selector 16 applies any of a predetermined set of MIDI instrument voices onto the percussion loop played. Typically, the drum set selector 16 is set to a specific instrument voice for the duration of a musical piece, score or other meaningful distinction point. Standard drum set instrument voices could include, for example, pop, jazz, rock or other classification of voice. In the example shown in FIG. 1, the drum set selector 16 takes the form of a dial that rotates to any of several predetermined positions, each having a positive detent that matches an indicator on the dial with a label on the case 12.

The volume selector 14 is used to set the line level of the outputs 40. This allows for a simple and customizable output level for the device. Other third party pedals up line in a daisy chain of pedals may also be affected by the volume selector 14. Typically, the volume selector is used to affect the prominence of the percussion sound generated by the device relative to the guitar sounds that pass unmodified through the device. In a preferred version of the device the volume of a guitar signal is not affected by the device and is otherwise unaffected. The overall volume of the sounds generated are generally controlled at the main amplifier level, external to the invention. In the example shown in FIG. 1, the volume selector 14 takes the form of a dial that rotates to any infinitely variable position. The volume selector 14, in a preferred version only affects the volume of the drum beats produced by the device.

The style selector 18 adds a further component to the output by the invention. Typical styles may include, for example, jazz, blues, pop, rock or other styles pre-selected by the user. Similar to the drum set selector 16 the style is often left unchanged for a musical piece or longer. In the example shown in FIG. 1 the style selector 18 takes the form of a dial that rotates to any of several predetermined positions, each having a positive detent that matches an indicator on the dial with a label on the case 12.

The tempo BPM (beats per minute) selector 20 is one of two preferred means to adjust the rate or tempo of the beat produced by the device. Generally, the tempo selector 20 is a knob with a pre-determined range of tempos. For example, the version shown in FIG. 1 ranges from one to two hundred BPM. The tempo can then be dialed in manually to any of an infinite BPMs in the pre-determined range. Preferably the display 24 will briefly blink, displaying the actual BMP dialed in by the tempo selector 20 providing an empirical measure.

The alternate means of selecting BPM is the tap sensor 26. Typically, the tempo selector 20 is set to zero which initiates the tap sensor 26 to be ready for a manual input. The musician then can physically tap a beat on the tap sensor 26 which will then make a BPI calculation to match the musician's finger taps and match that rate to the tempo output. When the tempo selector 20 is then later moved off of the zero position, the tempo selector 20 knob takes precedent and the tempo of the beat will then match that set on the tempo selector 20 indicator.

An optional functionality of the tap sensor 26 is activated by turning the tempo selector 20 to zero and then tapping the tap sensor 26 only once. This indicates to the processor controlling the device to receive input from the pedal 28 to match the tempo inputted from the pedal 28 or tap sensor 26. This provides a means to adjust the tempo almost hands free. Some musicians prefer to tap a tempo with their foot rather than with their finger as must be done with the tap sensor 26 alone.

An important feature of the invention is the ability to produce a looped rhythm and have the ability to introduce short "fills" or embellishments to the rhythm. It is desirable to be able to interject different fills into a rhythm at specific places in a musical piece. It is also desirable to have different looped rhythms in a single musical piece. Taken one step further, the present invention allows each different rhythm loop to have associated with it a series of fills specific to that rhythm loop.

Figure 6:
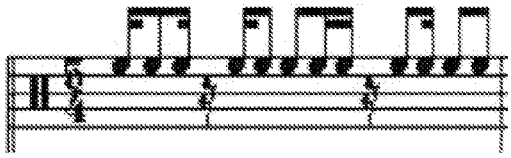
FIG. 6 is a sheet music representation of an example of a percussion fill.

In other words, the device has the ability to cycle between a pre determined series of MIDI rhythms, each having a pre-selected sub-set of available fills. An example of a MIDI rhythm is demonstrated in FIG. 5 and an example of a fill is shown in FIG. 6. But one of infinite examples of the more complex result of the controllable rhythm loops and fills is shown in FIG. 4.

In the example in FIG. 4 there are two rhythm loops identified as a first type ("A") and a second type ("B"). Both the first type and second type are individually associated with three pre-selected fills, designated with a numerical subscript. Segments 85 through 95 in FIG. 4 are an example of how the device might ideally work to play a complex percussion set. In this example, there are unique fills and a transition fill associated with each of loops "A" and "B", designated by subscript notation. Note that although this chart is temporal the length of time of any particular segment cannot necessarily be directly extrapolated in other words, each segment is played for a distinct length of time.

Still referring to FIG. 4 where the percussion sequence begins with a tap of the foot pedal 28 and loop segment 85 begins the first rhythm loop "A", such as the rhythm shown in FIG. 5, which repeats indefinitely. To introduce a fill, such as the fill example shown in FIG. 6, the musician taps the pedal 28 again to begin fill segment 86. Fill segment 86 concludes after it completes one play of the fill and then automatically reverts to rhythm loop "A", beginning loop segment 87, which repeats indefinitely. At the musician's subsequent tap onto pedal 28, fill segment 88 begins consisting of a new distinct fill. When that fill plays once through, the beat again returns automatically to rhythm loop "A" represented by loop segment 89. Yet a third distinct fill is initiated by another tap onto the pedal 28 represented by fill segment 90 which when completed reverts back to rhythm loop "A" in segment 90*a*. Continuing the example in FIG. 4, the musician taps the pedal 28 again and the fill segment cycle repeats by again playing fill variation one, shown in segment 90*b*. Once this fill segment completes rhythm loop "A" returns in segment 90*c*. The user then presses and holds down pedal 28 and the transition fill is initiated as demonstrated in segment 90*d*. When the pedal 28 is released segment 91, the next in the series of rhythm loops, identified in this example as "B", is initiated and begins cycling indefinitely. Pedal 28 is tapped to begin segment 91*a* and the first fill associated with this rhythm loop is played once and then reverts to rhythm "B" in segment 91*b*. The second fill sequence associated with rythym "B" begins with another tap to the pedal 28 at segment 92 and naturally reverts the rhythm loop "B" in segment 93. A transition fill, designated by segment 94 is initiated by holding the pedal 28 and when released the next rhythm loop, in this example back to type "A" is begun as shown in segment 95.

Although the chart in FIG. 4 shows two rhythm loops, each having three associated fills, it must be appreciated that with enough memory and processing power that there may be a many rhythm loops each with a large number of fills. The number of rhythm loops and fills is largely limited by how many the musician has ability to manage and play. For most songs a musician might use about no more than ten rhythm loops with each having ten or fewer fills. This is in no way limiting to the capability of the invention, because, with sufficient memory and processing power, there is no practical limit to the number of rhythm loops and associated fills that could be programmed.

Similarly, in some scenarios the device may be programmed with fewer rhythm loops and fills than shown in FIG. 4. For example, a musician may prefer to have a two rhythm loops with each having only one or two associated fills. This may be easier for the musician to manage while the device could retain the expanded functionality to add more complex patterns at other times.

A port 38 for an external switch is preferably provided. This external switch may be a dumb foot switch that acts as a signaling means to cause the device to overlay a pre-selected sound, such as a thunder clap, cymbal crash, or any other single-shot sound, to be played by the device. Alternatively, the external switch may contain an external audio generator that contains its own single-shot sound that is then incorporated into the sounds generated by the device itself and transmitted on to an external amplifier through the outputs 40.

Power may be supplied to the device by an internal supply such as a replaceable or rechargeable battery. It is anticipated that a common nine-volt dry cell battery would be sufficient. If the device is included in a rack system or daisy chained to other effects pedals, an external wired power supply may also be delivered to the device via a power supply interface means such as shown by port 34.

Inputs 30 are provided to receive an external audio source such as other effects pedals or instruments such as a keyboard or guitar. These inputs 30 are available for stacking a variety of devices in a daisy chain format where all signals generated by a variety of devices are funneled through a single stream through the outputs 40 to a final stage such as a mixing board, amplifier and speaker combination, or other device designed for receiving line level input from the invention. The inputs 30 may channel the incoming audio stream through the audio processors integral to the device, or may alternatively bypass the signal processing capability of the invention and deliver an unaltered signal to the outputs 40 where the signal may be combined with the processed signals generated by the invention.

Inputs 30 may be designed to readily accept digital or analog audio signals in monophonic (mono), stereophonic (stereo) or other multi-rack format. If a known signal source is mono, then one specific channel may be designated as such. Similarly, the outputs 40 may be digital or analog and carry any pre-designated number of parallel signals, typically mono or stereo format.

The device is highly flexible and adaptable due, inter alia, to its internal signal processor and memory module. The memory module is adapted to store a plurality each of MIDI percussion segments, a MIDI fills, MIDI instrument voice processes, style processes and other related data to perform the functions described, herein. In a preferred version, the memory module is produced pre-loaded with several MIDI drum set voices, several. MIDI style processes, a number of rhythm loops and fills. In this form the device can be used directly off the shelf.

For more sophisticated users the device can be interfaced with an external computer device via a port 38 which may take the form of universal serial bus (USB) port or other type of interface commonly available in the art. Similarly, the device may have a wireless communication means such as wi-fi, blue tooth or other wireless communication means that may become commonly available as technology progresses from time to time.

Additionally available as an option is an external memory card slot 32 that can provide other rhythms, voices, processes and other data that may be used by the device. Current technology for a card slot 32 interface could be memory cards, flash drives, solid state drives or other types of data storage or transmission means that may become available from time to time as technology progresses. The memory card slot 32 may be utilized to deliver additional content to the internal memory means provided with the device or may augment the provided on board storage capacity that is integral to the device.

Figure 3:
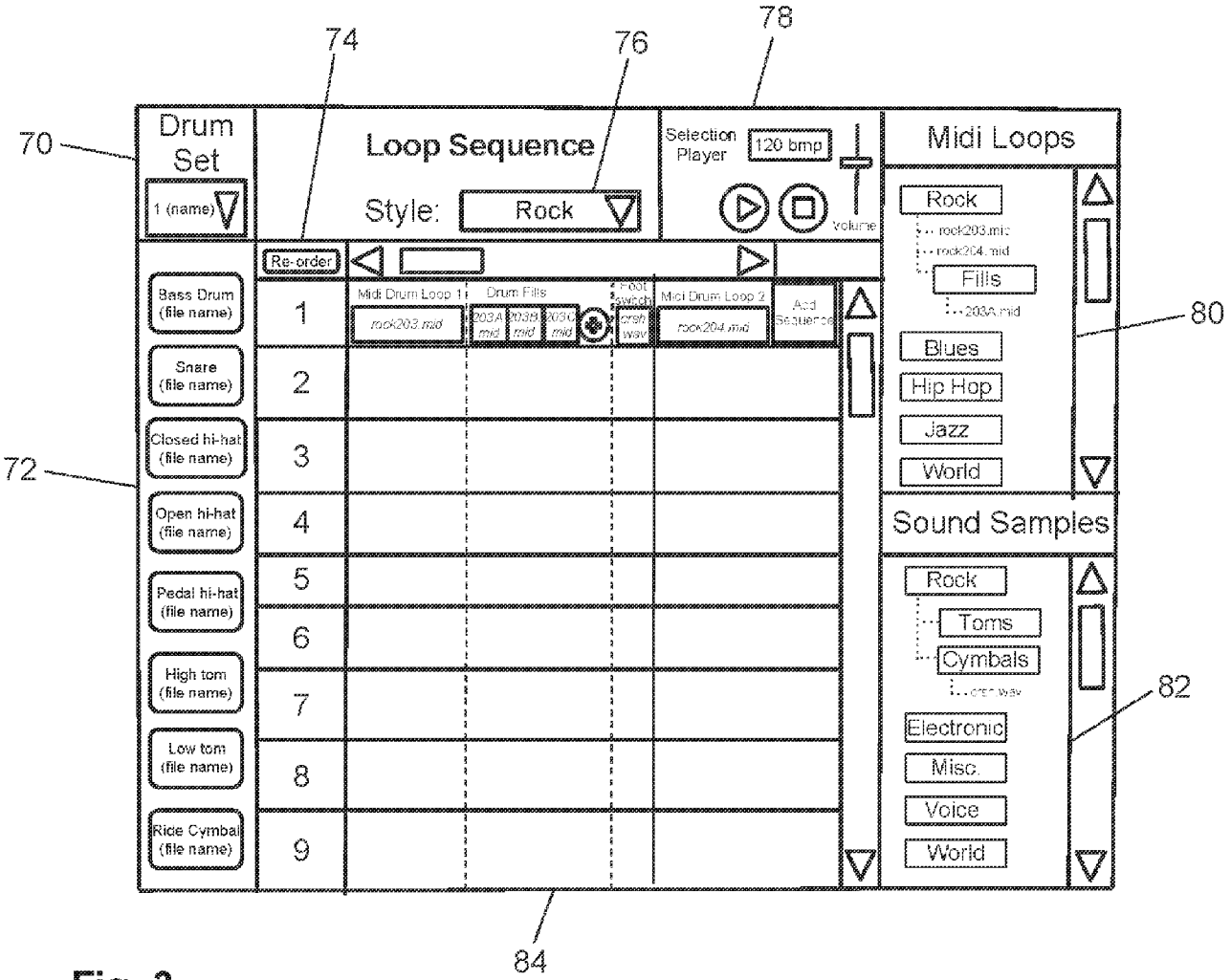
FIG. 3 illustrates an example of a screen shot of the control panel as seen on an external computer.

FIG. 3 is an example of what a computer interface screen shot might look like. The computer could be a personal computer directly connected to the device via a cable to the port 36 or connected wirelessly. If wirelessly, then the device could be Internet connected and would then be accessible anywhere on the cloud from other portable devices. Some mixing boards or other audio equipment may also be able designed to interact with the device to make changes to the MIDI files, rhythms, loops, fills, drum sets, sound samples, processes or other variables stored on the device or affecting how the audio generated is manipulated or produced. It may also include a selection of whether the signal received from the inputs 30 is filtered through the processor logic or simply passes unaffected to the outputs 40 on the device.

When the invention is interfaced with a computer a software program can be used to manipulate the various features of the device and may appear similar to the example shown in FIG. 3 that comprises, inter alia, a drum set 70 identifier with instrument voice definitions for the component instruments 72. Here the drum set 70 can be conveniently categorized and named according to the musician's needs. For each drum set 70 the several component drums can be set individually as component instruments 72. Typically the component instruments 72 are individual MIDI instrument voice instructions or processes that may simulate, for example, a specific snare drum or type of cymbals, which give personalized characteristics to each individual instrument. Drum set elements are sound files, for example MP3 or WAV files. Multiple drum sets 70 may be organized, each having a predetermined set of component instruments 72. By dragging and dropping individual files from the host computer the manipulation of component instruments is easily made and verified in a graphical format.

By organizing the drum set 70 from individual files of instrument voice files in memory storage space may be saved by merely referencing the instrument voice as a component instrument 72 from a catalog held in the storage means. If needed, the musician may then substitute out an instrument voice from a specific component instrument 72 instead of creating a whole new drum set 72 which is an inefficient use of storage space. This also provides for maximum flexibility of what an drum set 70 may sound like.

The style of the loop sequence 76, such as rock, metal, jazz or others, can be set for a particular set of percussion loops. For testing purposes the percussion selection may be played with options in the control pane 78. The several MIDI loops may be organized and changed in pane 80 which references the style selector 18 found on the device.

Sound samples 82 can also be moved in a drag and drop fashion to any of the other panes in the computer interface screen. This may include a browse-able library of loops, fills, instrument voices, processes and any other files which may be utilized for the various effects and uses of the invention.

The main window 84 is where the queued loops and their associated fills may be established. In this example shown in FIG. 3, there are two main drum loops and an auxiliary sound defined. The auxiliary sound is executed with an external foot pedal connected to the port 38. The first drum loop has three fills designated. More drum loops may be added into the sequence for a particular set. The sets are numbered from one to nine in this example, but may be expanded to include any number of sets. The sets may be easily re-ordered by selecting the "re-order" function. Alternatively, all of these files and functions may be controlled with the drag and drop method.

To improve the functionality of the software, custom file extensions, preferably having a proprietary format will be utilized. For example, in a preferred version of the software a ".bdy" file extension may be used to save the profile of the user including most settings for the way the device is configured by default for that user, including drum sets, drum sequences, etc. The user can then load this file on another copy of the device and get the exact same setup. Alternatively, the user may then be able to have multiple profiles, one for each ".bdy" file. This is beneficial, for example, if the user is playing a different concert which needs different sequences and drum sets, he can quickly load this ".bdy" file and have the device set up in a customized way.

Another proprietary extension used with the software may be a ".seq" file extension which designates a loop sequence file. This file will be a combination of the MIDI and WAV files that make the loop sequence or 'song'). This allows the user to save a loop sequence he likes and use it on another copy of the device or share it with his friends without having to re-build it again out of the separate MIDI and WAV files.

Yet another proprietary extension used with the software may be a ".drm" file extension which designates a drum set file. This file saves the combination, of WAV files used in the drum set. The user can make his own drum set and then share it with his friends by just sending this file instead of all the separate WAV files and avoids having to re-build the drum set instructions again in the interface software.

Figure 2:
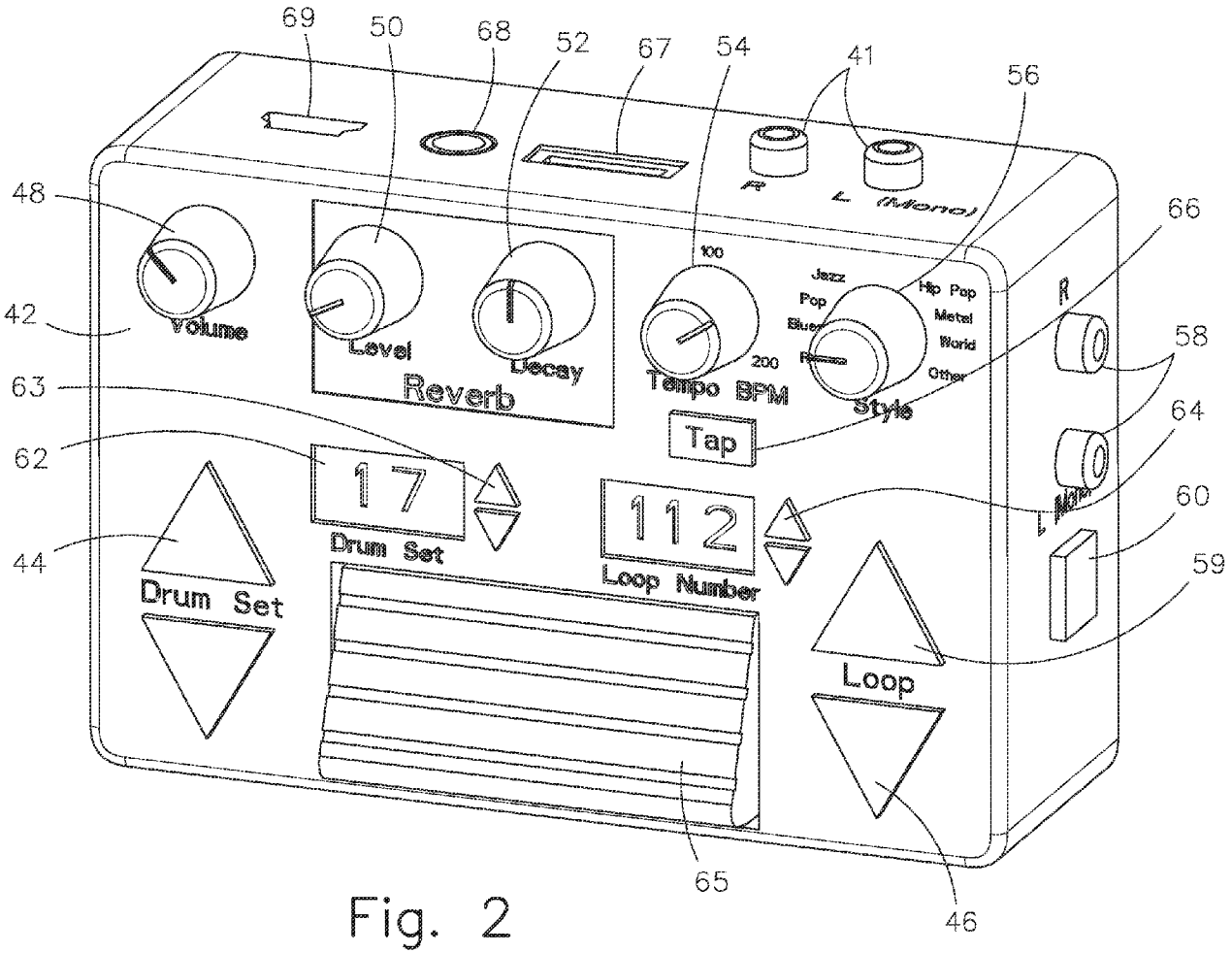
FIG. 2 shows a perspective view of an alternate version of the device.

FIG. 2 is an alternate version of the percussion pedal and is shown to include, inter alia, outputs 41, a case 42, a selector 44, a selector 46, a selector 48, a selector 50, a selector 52, a selector 54, a selector 56, inputs 58, a selector 59, a port 60, a display 62, a selector 63, a display 64, a pedal 65, a sensor 66 and card slot 67, a port 68 and a port 69. Many of the controls and features of the devices shown in FIG. 1 have analogs to the device in FIG. 2.

Inputs 58, either mono, stereo or multi-channel, accept input from another device such as an external pedal or instrument. The signal inputted is then outputted via outputs 41 either with or without audio manipulation from the device. An optional external pedal may be connected to port 60 to receive a signal from said pedal to generate a single sound set per time the external pedal is pressed, such as a hand clap, cymbal crash or other pre-selected sound.

The tempo selector 54, style selector 56 and volume selector 48 function similarly to the alternate device as shown in FIG. 1 and described, infra. The tap sensor 66 may be used as an alternate to the selector 54 to manually tap in the tempo which is briefly displayed as a flashing value on display 64.

The pedal 65 functions in a similar way to the pedal 28 in the version shown in FIG. 1 and described above in combination with FIGS. 4-6 to cycle through the percussion loops and associated fills. Also like the version shown in FIG. 1, holding the pedal 65 down continuously plays the transition fill without reverting back to the underlying percussion loop and a double tap stops all loops and fills.

One of the differences between the versions of the invention shown in FIG. 2 are the addition of foot operated drum set selector 44 with corresponding display 62 and foot operated loop selector 46 with corresponding display 64. Finger operated drum set selector 63 and loop number selector 59 are optionally present.

Another difference is the additional reverb level selector 50 and reverb decay selector 52 which can add a desirable feature set when used in combination with a guitar feeding signal into the inputs 58. Preferably, the reverb selectors 50 and 52 are only applied to the percussion sounds but not the external sound generating device, such as a guitar, fed into inputs 58.

Port 69 preferably is present to provide connectivity means to an external computer for organizing the file structure and designating which fills are associated with a particular percussion loop and other features as shown in FIG. 3 and described above.

Port 68 may accept an external power supply as an alternate to an battery inside the case 48. Card slot 67 accepts an external memory card with additional percussion loops, instrument voices, fills or other electronic instructions necessary to the device.

The user may want to select specialized transition fills to shift from verse to chorus and chorus to verse. When the user wants the switch from verse to chorus, he presses down the pedal and holds it or some other distinct signal means. The transition fill plays over and over until he releases the pedal and the beat reverts back to the subsequent percussion segment of the underlying drum loop. This way the user can transition between drum parts more in the way an actual drummer would by timing the switch exactly by lifting his foot off the pedal when he wants the switch to take place. A similar procedure may be followed when the user wants to switch from chorus back to verse.

The invention can also be fairly described as a percussion signal generator comprising a memory module, a foot operable pedal, an audio signal output and a signal processor. The memory module stores a plurality of percussion-segments and a plurality of fills that are adapted to be executable audio files. The percussion-segments are adapted to be played in a perpetual loop, playing seamlessly from the end of the loop and starting again at the beginning indefinitely. The memory module can store one or more pre-determined fill-subsets comprised of a sequence of one or more of said fills and each percussion-segment has an associated fill-subset of one or several distinct fills. The memory module can store at least one pre-defined percussion-compilation comprised of one or more of said percussion-segments, sequentially ordered and combined with said associated fill-subset. The processor module is adapted to execute said audio files resulting in generation of a percussion signal and delivery of said percussion signal to said audio signal output. Simultaneously, the signal processor is adapted to receive and recognize from said foot operable pedal any of several cues. When a discrete percussion-compilation is selected a first cue causes said signal processor to execute a first of said percussion-segments of a said discrete percussion-compilation. When the first cue is repeated it causes the signal processor to execute once a selected fill in an associated fill-subset and then reverts again to the same percussion-segment. A repeat of the first cue causes the signal processor to once execute a subsequent fill in the associated fill-subset or if the final fill of said associated fill-subset has been executed then the first fill in said associated fill-subset is again once executed and then reverts again to the same percussion segment. A second type of cue causes the signal processor to execute the subsequent percussion-segment of the percussion compilation and individual instances of the first cue cycle through one of each sequential, associated fill-subset. A third cue causes the signal processor to cycle through executing subsequent associated fills without interruption. A fourth cue stops the execution of said percussion compilation.

Variations of the percussion signal generator can further include a signal input means that receives a music signal feed from an external source and an adjustable reverb effect generator that imparts a reverb effect onto the music percussion signal without affecting the percussion signal and delivering said music signal and said percussion signal to said audio signal output. Generally, the percussion segments and fills are in any current art format or combination thereof, including for example MIDI, WAV or MP3. The device can include a memory card slot, an external signal generator, an external power supply and or an external computer connector. Optionally, a style selector, a tempo selector or a drum set selector are included individually or in combination to further control the percussion signal generated or to affect the music signal passing through the device from another source, such as a guitar.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A method to generate a percussion signal including a memory module, a foot operable pedal, an audio signal output and a signal processor;

Said memory module stores a percussion-compilation that is further comprised of a plurality of fill-sets and a plurality of sequential percussion-segments;

Each of said fill-sets are associated with a specific percussion-segment;

Said fill-sets are further comprised of multiple, sequential individual-fills and a transition-fill;

For each fill-set, after the last in the sequence of individual-fills has been played the sequence begins over with the first individual-fill in that fill-set;

Each of said percussion-segments, said individual-fills and said transition fills are executable audio files or executable MIDI instructions;

Each of said percussion-segments and said transition-fills are played in a perpetual loop;

Said signal processor executes said audio files stored in said memory module resulting in generation of a percussion signal and delivery of said percussion signal to said audio signal output;

Said foot operable pedal receives and delivers to said signal processor any of a human foot generated first cue, second cue, third cue and a fourth cue;

When said first cue is applied to said foot operable pedal, said signal processor begins to execute a first of said sequential percussion-segments of a said percussion-compilation in a perpetual loop;

When said second cue is applied to said foot operable pedal said signal processor interrupts the playing percussion-segment and executes once a first sequential individual-fill of said fill-set associated with the then playing percussion-segment and then reverts to playing the interrupted percussion-segment;

When said second cue is again applied to said foot operable pedal said signal processor interrupts the playing percussion-segment and executes once a subsequent individual-fill from said associated fill-set and then reverts again to the interrupted percussion-segment;

When said third cue is applied to said foot operable pedal said signal processor interrupts the playing percussion-segment and executes once the transition-fill in the fill-set associated with the playing percussion-segment and then executes the subsequent percussion-segment in the percussion-compilation;

When a fourth cue is applied to said foot operable pedal said signal processor stops the execution of said percussion compilation.

2. A percussion signal generator as disclosed in claim 1 further including that said first cue is a single toe tap, said second cue is a single toe tap, said third cue is a toe press-and-hold and said fourth cue is a double toe tap.

3. A percussion signal generator as disclosed in claim 1 further including a signal input means that receives an external music signal and an adjustable reverb effect generator that imparts a reverb effect onto said percussion signal without affecting said external music signal and delivering said external music signal and said percussion signal to said audio signal output.

4. A percussion signal generator as disclosed in claim 1 further including that said percussion segments, individual fills and transition fills are in any format selected from MIDI, WAV or MP3.

5. A percussion signal generator as disclosed in claim 1 further including a memory card slot, an external signal generator, an external power supply and an external computer connector.

6. A percussion signal generator as disclosed in claim 1 further including a style selector, a tempo selector and a drum set selector are included to further control the percussion signal generated.

* * * * *